United States Patent [19]

Kuboyama

[11] 4,426,793

[45] Jan. 24, 1984

[54] HEAT GENERATING APPARATUS AND ITS PROCESS UTILIZING AIR CIRCULATION AND CONVECTION

[76] Inventor: Nobuyoshi Kuboyama, 28-9-1, Shimomiyamori, Aza, Miyamori-Mura, Iwate-Ken, Japan

[21] Appl. No.: 349,064

[22] Filed: Feb. 16, 1982

[30] Foreign Application Priority Data

Feb. 19, 1981 [JP] Japan ..... 56-22171
Feb. 23, 1981 [JP] Japan ..... 56-24216

[51] Int. Cl.[3] ..... F26B 23/00

[52] U.S. Cl. ..... 34/15; 34/39; 34/92; 126/247

[58] Field of Search ..... 34/15, 92, 201, 39, 34/218, 230, 223, 224, 232; 126/247; 122/26

[56] References Cited

U.S. PATENT DOCUMENTS 3,140,929 7/1964 Johanson ..... 34/92
4,319,408 3/1982 Kuboyama ..... 34/39

*Primary Examiner*—Larry I. Schwartz

[57] ABSTRACT

This invention relates to a heat generating apparatus and its process utilizing air circulation and convection, wherein a chamber having air friction heat generating means is provided with outer air induction means and air flow therewithin is circulated forcibly as convective flow, thereby the temperature distribution becoming uniform throughout the interior of the chamber. Thus, it can be employed as a powerful heat source or a heating or drying chamber.

6 Claims, 10 Drawing Figures

HEAT GENERATING APPARATUS AND ITS PROCESS UTILIZING AIR CIRCULATION AND CONVECTION

BACKGROUND OF THE INVENTION

This invention relates to a heat generating apparatus and its process utilizing air circulation and convection.

The principle of this invention is based upon U.S. patent application Ser. No. 200,563 now U.S. Pat. No. 4,319,408 entitled "Heating Process and Its Apparatus in Reducing Air Pressure within a Chamber at a Balanced Level" which was filed on Oct. 24, 1980 in U.S. Patent and Trademark Office, claiming the priorities of basic Japanese Patent Application Nos. 55-94630, 55-94631, 55-132065 and 55-132066, now U.S. Pat. No. 4,319,408.

Following the above patent application, the Applicant filed in December, 1981 U.S. patent application Ser. No. 329,818 entitled "A Heat Generating Apparatus and its Process" claiming the priority of basic Japanese Patent Application No. 56-46436.

According to one aspect of the latter U.S. patent application, the air friction heat generating means is installed in a closed chamber having no outer air induction means. Likewise, provided that the outer air induction means is not installed in the closed chamber, means for causing air circulation and convection is installed therein.

The present invention represents a further novel element of the technical concept disclosed in the above two U.S. patent applications.

SUMMARY OF THE INVENTION

A general object of the present invention is to provide a heat generating apparatus and its process utilizing air circulation and convection, wherein a chamber is provided with outer air induction means and air flow therewithin is circulated forcibly as convective flow, thereby the temperature distribution becomes uniform throughout the interior of the chamber.

Referring to its structure more in detail, a rotary means which is installed in the chamber performs the function of air heat generating means. The rotary means is effective to reduce air pressure therein to a reduced balanced level. In the meantime, the air friction heat generating means in the rotation area of the rotary means is actuated and air friction heat is generated. Beneath the air friction heat generating means there are formed a trailing rotary means and a guide means for causing forcible air circulation and convection. By cooperation of the above two means, the air temperature within the chamber can be rapidly and uniformly raised to a desired temperature. Thus, the chamber can be employed as a powerful heat source or a drying chamber.

These and other objects, features and advantages of the invention will become more apparent from the following description taken in connection with the accompanying drawings.

BRIEF DESCRIPTION OF THE ACCOMPANYING DRAWINGS

DETAILED DESCRIPTION OF THE INVENTION

Figure 1:
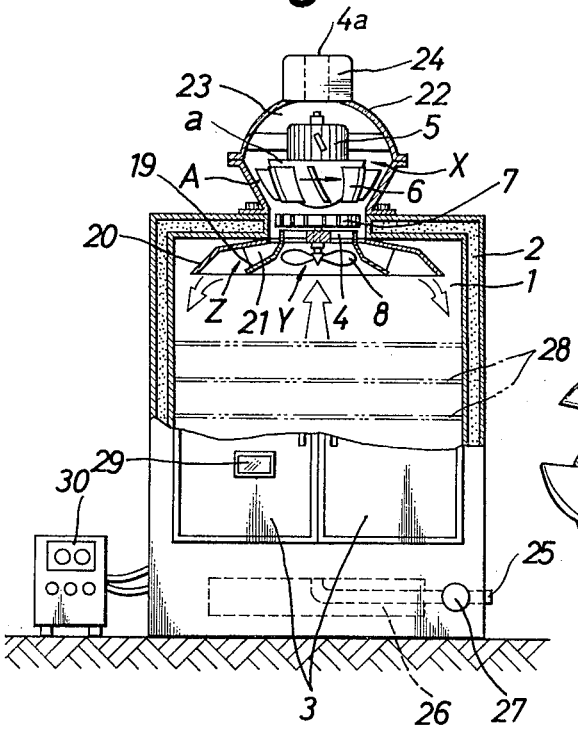
FIG. 1 is a partially cutaway front view of a heat generating apparatus and its process utilizing air circulation and convection according to this invention.
Figure 2:
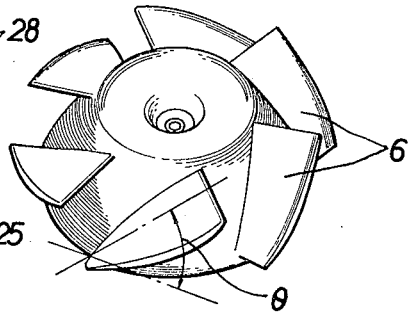
FIG. 2 is a perspective view of rotary means mounted in the above apparatus.
Figure 3:
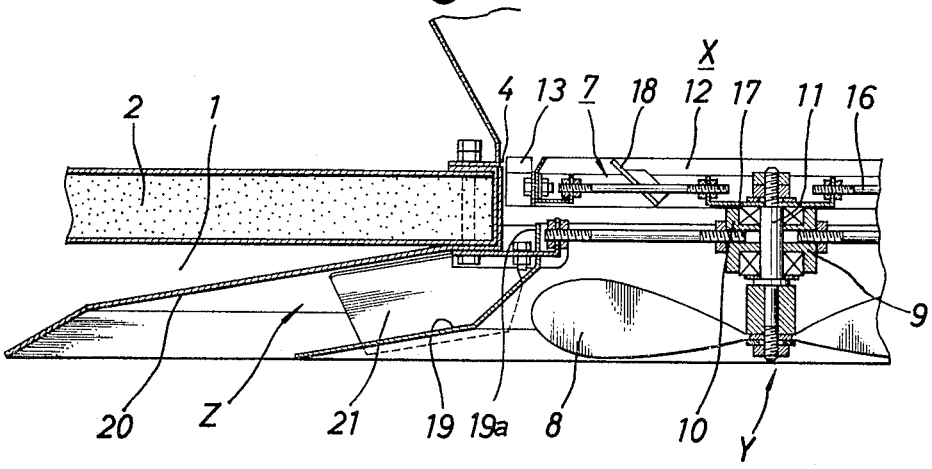
FIG. 3 is an enlarged cross section of a main part of the apparatus.
Figure 4:
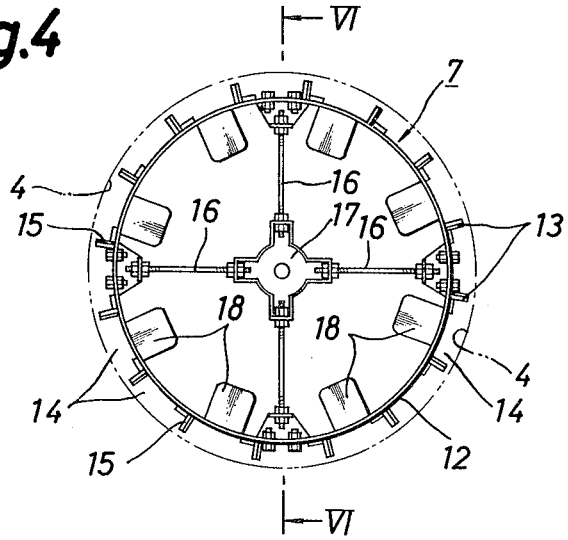
FIG. 4 is an enlarged plan view of a rotary impeller mounted in the above apparatus.
Figure 5:
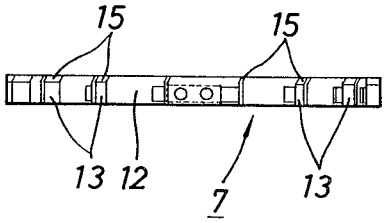
FIG. 5 is a side view of the rotary impeller.
Figure 6:
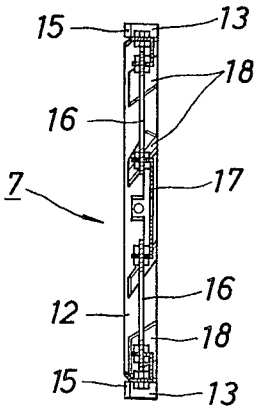
FIG. 6 is a cross section taken on VI—VI of FIG. 4.
Figure 7:
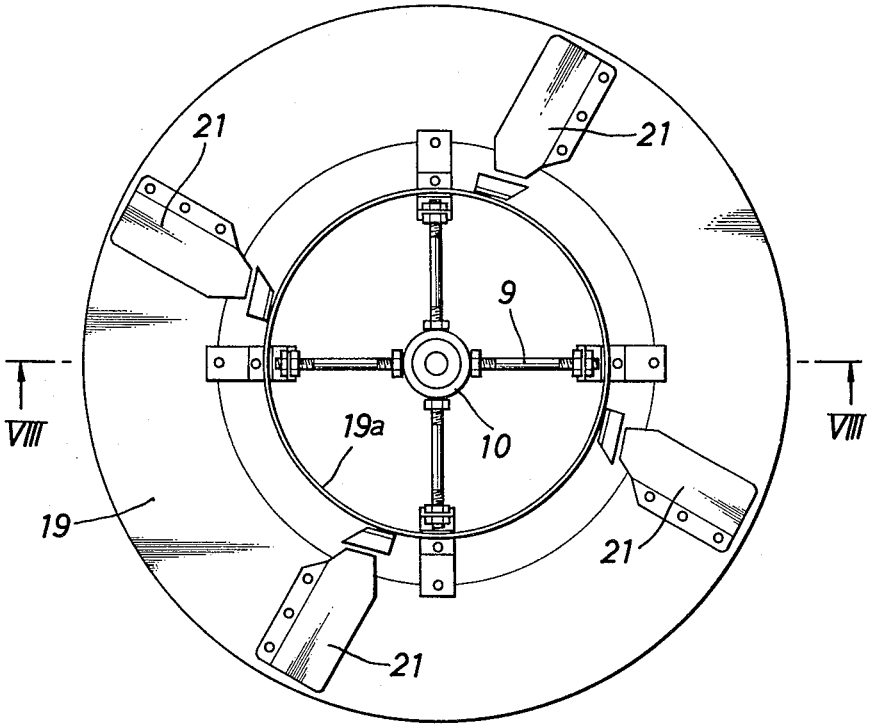
FIG. 7 is an enlarged plan view of a combination of a cross-shaped support frame with a sloping plate.
Figure 8:
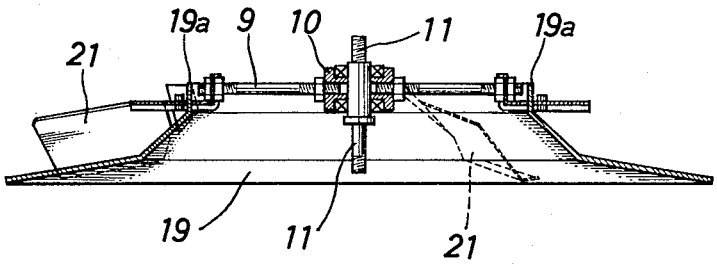
FIG. 8 is a cross section taken on line VIII—VIII of FIG. 7.
Figure 9:
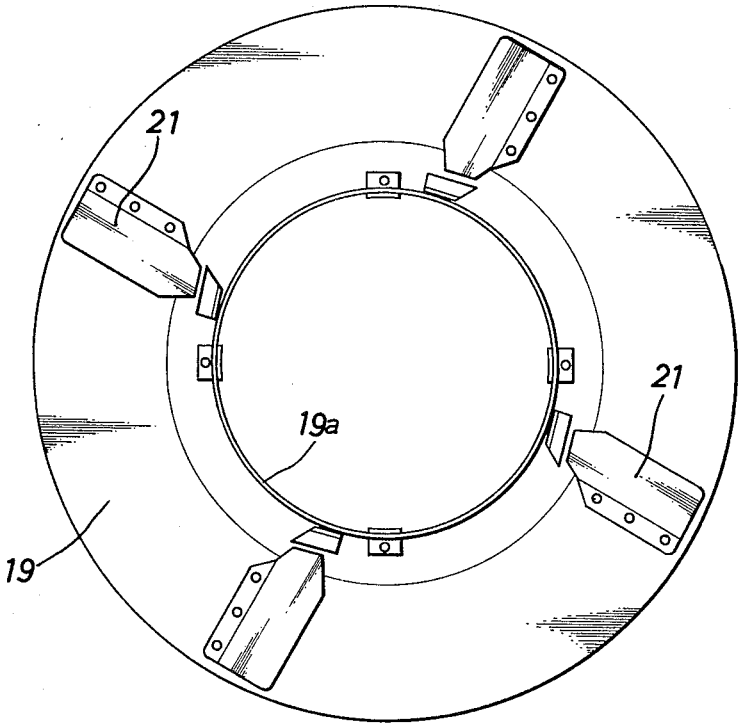
FIG. 9 is a plan view of the sloping plate.
Figure 10:
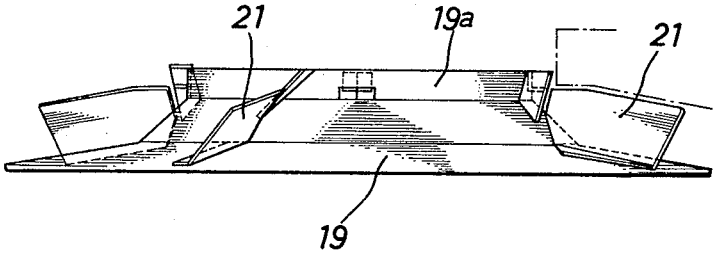
FIG. 10 is a front view of the sloping plate.

Referring first to the construction of FIG. 1, numeral 1 is a closed chamber of square cross section which is shielded by outer walls 2. The outer wall 2 is of a heat insulating and heat resisting structure. Numeral 3 is a pair of doors for incorporating articles in the chamber 1 or taking them out of it.

Numeral 4 is a suction opening which is formed in a ceiling center of the chamber 1. The suction opening 4 is communicated with an air outlet 4*a*. In the suction opening 4 there is mounted an air friction heat generating means X having rotary means a. The air friction heat generating means X is effective to reduce air pressure within the chamber to a balanced level. The rotary means a is provided with a propeller fan or a multiblade fan or the like, each of which has a plurality of vanes 6 rotatable by a motor 5. Each vane 6 has a certain inclination $\theta$ so that air within the chamber 1 can be suctioned and discharged smoothly. And in a rotation area of the rotary means a there is formed a friction heat generating area A where air is heated by friction.

Numeral 7 is a second rotary means or a rotary impeller which is spaced concentrically from the rotary means a of the air friction heat generating means X. Symbol Y is a trailing rotary means which is rotated by suction vane means 8 as well as by the rotary impeller 7.

Referring more in detail to the trailing rotary means Y, a cross-shaped support frame 9 is mounted in the lower part of the suction opening 4 and a center of the support frame 9 is provided with a shaft bearing portion 10 so as to correspond with a center of the rotary means a. The rotary impeller 7 is mounted above the shaft bearing portion 10 and fixed with a shaft 11, while the suction vane means 8 is mounted below the shaft bearing portion 10 and is fixed with the shaft 11. The rotary impeller 7 comprises a ring 12 whose diameter is smaller than the diameter of the suction opening 4, and a plurality of vanes 13 which are projected externally from the ring 12. Thus, a large number of air cells 14 are formed by enclosure of an interior of the suction opening 4, the ring 12 and the plurality of vanes 13. Numeral 15 is a curvature portion of each vane 13 which is bent obliquely from an upper end thereof in order to increase rotation power. Numeral 16 is four bars of a central mounting means 17. Further, there are mounted a number of suction vanes 18 on the inner side of the ring 12 to suction upwardly air within the chamber.

The suction vane means 8 may be a normal fan. What is more important is that its rotary vane is capable of suctioning upwardly air within the chamber. The suction vane means 8 is covered by a nearly frusto-conal cover 19 of which upper annular end is fixed with both ends of the support frame 9. Thus, the suction area of the suction vane means 8 is defined by the frusto-conal cover 19.

Further, the frusto-conal cover 19 may be rotatably fixed with the shaft 11 and provided at its lower side with a plurality of vanes having the suction effect. Such a frusto-conal cover (not illustrated) having a plurality of vanes has also a clearly defined suction area. It is optional to remove the suction vane means 8.

In this embodiment there is formed guide means Z for causing forcible air circulation and convection in order to circulate effectively air flow within the chamber 1 and to maintain a uniform temperature distribution throughout the chamber. For this purpose, a frusto-conal guide cover 20 is extended downwardly from the end of the suction opening 4. Between the upper guide cover 20 and the lower cover 19 there are mounted four regulating plates 21 for regulating a direction of air flow.

Numeral 22 is a cylinder case of the motor 5 which includes a rotation area of the rotary means a and an air discharge passage 23. Numeral 24 is a silencer which is mounted on the cylinder case 22.

Numeral 25 is outer air induction means which is installed in the lower part of the chamber 1. An additional heater 26 such as an electric heater, a gas heater, an oil heater or the like may be incorporated in the outer air induction means 25 in order to increase the heating effect. Further, the additional heater 26 may be controlled by a thermostat (not illustrated). The outer air induction means 25 includes an adjusting valve 27 for adjusting flow of the outer air. The adjusting valve 27 may be replaced with an automatic control valve which is opened or closed by detecting the chamber temperature or an air pressure difference between the inside of and the outside of the chamber 1.

Numeral 28 is a shelf such as a net or a perforated plate for incorporating wet articles in the chamber 1. It is optional to modify the size and shape of the shelf 27 in accordance with the kind and quantity of the wet articles.

Numeral 29 is a window for inspecting the chamber inside and numeral 30 is a control box comprising various measuring meters and a control panel.

Now, the function and process of this invention will be described.

When the motor 5 is energized, a plurality of vanes 6 are rotated. Then, the air friction heat generating means X is actuated. The air pressure within the chamber 1 is gradually reduced since air therewith is suctioned forcibly and discharged outside the chamber 1 by rotation of the plurality of vanes 6. And a difference between a reduced air pressure within the chamber 1 and a normal air pressure thereoutside becomes larger gradually, but after a short lapse of time the difference therebetween is maintained at a balanced level. The air pressure difference is defined by a suction force of the rotary means a and a gap scale between the suction opening 4 and the rotary vanes 6, but the difference between the reduced air pressure within the chamber 1 and the normal air pressure thereoutside is maintained at a balanced level as long as the vanes 6 are rotated continuously.

At a reduced balanced level of the air pressure an air retaining phenomenon is generated in the friction heat generating area A where the vanes 6 are rotated. Since the vanes 6 are rotated continuously at high speed in that area A, air friction heat is generated and its temperature is gradually raised.

When the rotary means a is rotated, the trailing rotary means Y positioned coaxially thereunder is rotated in the same direction by the heated air flow generated by the rotary vanes 6 of the rotary means a. And air within the chamber is discharged outside the chamber by rotation of the trailing rotary means Y exclusively until air pressure within the chamber is reduced to a balanced level, that is, a difference between the reduced air pressure within the chamber and the air pressure outside the chamber is maintained at the balanced level.

After the air pressure difference therebetween reached a nearly balanced level, air flow in the cells 14 is placed in a heated condition. The heated air is introduced into a conical space between the upper guide cover 20 and the lower cover 19 by way of a number of regulating plates 21 and supplied to the interior of the chamber 1.

The heated air beneath the suction rotary vane means 8 is suctioned upwardly from downwardly by rotation of the suction vane means 8 driven integrally by rotation of the rotary impeller 7. The upward suction of the heated air is assisted by the suction effect of the suction vanes 18 mounted on an inner side of the ring 12. Thus, the air migrates forcibly back into the friction heat generating area A. The air is again heated by rotation of the rotary vanes 6 of the friction heat generating area A and discharged into the interior of the chamber by the rotary impeller 7.

Accordingly, by cooperation of the trailing rotary means Y and the guide means Z for causing forcible air circulation and convection, the air within the chamber 1 is forcibly circulated from the top of the chamber through the inner periphery thereof into the interior thereof and migrates back from the center of the chamber 1 into the air friction heat generating means X. The air flow is characterized by forcible convection flow and spiral vortex effect.

Owing to air circulation from up to down and from down to up, the temperature of the heated air throughout the chamber 1 can be raised rapidly and uniformly to a desired level. In addition, the heated air migrates uniformly to a number of shelves 28 mounted in the chamber 1, whereby the wet articles placed on the shelves 28 can be heated and dried effectively. A water content evaporated from the wet articles is discharged outside the chamber 1 through the suction opening 4. Or, outer air may be introduced into the chamber 1 by operating the adjusting valve 27 of the outer air induction means 25, thereby the evaporated water content is replaced with the introduced outer air. Thus, the wet articles can be dried effectively within a short time. Accordingly, the present invention contributes to reducing energy consumption on a large scale.

Further, since the heated air is circulated uniformly throughout the interior of the chamber 1 by forcible convection flow, the temperature distribution therein becomes uniform. In addition, outer air may be introduced thereinto intermittently. In this way, the drying effect of the wet articles is promoted remarkably and dried articles keep their original color without color change. Therefore, they are high-quality products.

It is to be understood that the air friction heat generating means X, the trailing rotary means Y and the guide means Z for causing forcible air circulation and convection are not limited to the specific embodiments as described above. It is optional to mount each of them in a desired position of the chamber, e.g. at its side or its bottom. Further, it is optional to mount one or more units of the above three means in accordance with the shape and size or the chamber 1.

Although the described embodiments of the chamber are of rectangular cross section, the shape itself is not a feature of the invention. Other shapes such as a cylinder and the like may also be used. When the chamber is a cubic structure, each corner thereof may be curved in order to decrease air flow resistance.

According to one aspect of this invention, since the air convection function and the spiral vortex function are actuated within the chamber by a joint cooperation of the trailing rotary means and the guide means for causing forcible air circulation and convection, it is very easy to obtain a uniform high temperature throughout the interior of the chamber.

According to another aspect, since heated or unheated outer air can be supplied to the chamber by actuating the outer air induction means, the drying effect of the wet articles incorporated in the chamber is enhanced furthermore. Thus, high-quality dried articles can be obtained.

What is claimed is:

1. A heat generating apparatus utilizing air circulation and convection, comprising:

a chamber including an air outlet;

an air suction opening in said air outlet of said chamber;

rotary means mounted in said air suction opening effective to reduce air pressure in said chamber to a reduced balanced level by forcibly suctioning air from said chamber and discharging said air outside said sealed chamber;

an air friction heat generating means in a rotation area of the rotary means, said air friction heat generating means being effective to add heat to air remaining in said chamber;

means for maintaining said air pressure in said chamber at said reduced balanced level whereby air remaining in the interior of said chamber is heated by air friction heat at said reduced balanced air pressure;

said means for maintaining including means for controlling a flow rate of air entering said chamber to a value effective to maintain a temperature of air remaining in said chamber at a predetermined level;

trailing rotary means opposing to said rotary means of said air friction heat generating means; and guide means effective in cooperation with said trailing rotary means for causing forcible air circulation and convection.

2. A heat generating apparatus utilizing air circulation and convection, according to claim 1, wherein said chamber is employed as a heat source.

3. A heat generating apparatus utilizing air circulation and convection, according to claim 1, wherein said chamber is employed for drying articles incorporated therein.

4. A heat generating apparatus utilizing air circulation and convection according to claim 1 wherein said guide means includes an inner frusto-conal body and an outer concentric frusto-conal body spaced from said inner frusto-conal body below said air friction heat generating means, said trailing rotary means including vane means within said inner frusto-conal body for suctioning air from within said chamber toward said air friction heat generating means, said guide means being effective to permit forcible air circulation from said air friction heat generating means into said chamber.

5. A heat generating apparatus utilizing air circulation and convection according to claim 4 wherein said trailing means further includes rotary means above said inner frusto-conal body for actuating said means within said inner frusto-conal body.

6. A heat generating process utilizing air circulation and convection, comprising:

providing a chamber including an air outlet;

forcibly suctioning air from within said chamber by rotary means at said outlet;

discharging forcibly suctioned air outside said chamber by rotation of said rotary means until air pressure within the chamber is reduced to a balanced level;

maintaining a difference between the reduced air pressure within said chamber and the air pressure outside said chamber at said balanced level;

generating air friction heat by continuous rotation of the rotary means, and permitting a substantial portion of said air friction heat to remain inside said chamber whereby said inside of said chamber is heated by the air friction heat at said reduced air pressure;

controlling a flow rate of air entering said chamber to a value effective to maintain a temperature of air remaining in said chamber at a predetermined level;

generating air flow of friction heat as a circulating flow by rotation of said rotary means;

suctioning air within said chamber from beneath said rotary means; and causing forcible convective flow which is spread downwardly in a spiral from toward four side walls of said chamber, thereby the temperature of heated air within the chamber being raised uniformly.

* * * * *